US009803903B2

(12) United States Patent
Higami

(10) Patent No.: US 9,803,903 B2
(45) Date of Patent: Oct. 31, 2017

(54) REFRIGERANT RECOVERY/LOADING MANIFOLD

(71) Applicant: DENGEN CO., LTD., Osaka-shi, Osaka (JP)

(72) Inventor: Issei Higami, Osaka (JP)

(73) Assignee: DENGEN CO., LTD., Osaka (JP)

( * ) Notice: Subject to any disclaimer, the term of this patent is extended or adjusted under 35 U.S.C. 154(b) by 168 days.

(21) Appl. No.: 14/886,212

(22) Filed: Oct. 19, 2015

(65) Prior Publication Data

US 2016/0187039 A1 Jun. 30, 2016

(30) Foreign Application Priority Data

Dec. 25, 2014 (JP) ..... 2014-262231

(51) Int. Cl.
*F25B 45/00* (2006.01)

(52) U.S. Cl.
CPC ..... *F25B 45/00* (2013.01); *F25B 2345/006* (2013.01)

(58) Field of Classification Search
CPC ..... F25B 45/00; F25B 2345/002
USPC ..... 62/77, 292, 298
See application file for complete search history.

(56) References Cited

U.S. PATENT DOCUMENTS 6,134,896 A * 10/2000 Brown ..... B60H 1/00585 141/83
2010/0298578 A1* 11/2010 Chang ..... C07D 319/12 549/379

FOREIGN PATENT DOCUMENTS

JP 6-88660 A 3/1994

* cited by examiner

*Primary Examiner* — Melvin Jones
(74) *Attorney, Agent, or Firm* — Cermak Nakajima & McGowan LLP; Tomoko Nakajima

(57) ABSTRACT

A refrigerant recovery/loading manifold for air-conditioning equipment has a manifold body and valves for opening and closing a passage inside the manifold body, the passages including a high-pressure-side passage, a low-pressure-side passage, a recovery-side passage, a vacuum-suction-side passage, a purging passage, and a common passage via which these passages communicate, at least a high-pressure-side valve being provided to the high-pressure-side valve being provided to the high-pressure-side passage, and at least a low-pressure-side valve being provided to the low-pressure-side passage; wherein a high-pressure connection means is provided to the low-pressure-side passage, the high-pressure connection means having a valve mechanism and being able to connect with a high-pressure-side quick joint.

4 Claims, 8 Drawing Sheets

REFRIGERANT RECOVERY/LOADING MANIFOLD

BACKGROUND OF THE INVENTION

1. Field of the Invention

The present invention primarily relates to manifold used for purposes such as refrigerant recovery in air-conditioning equipment.

2. Description of the Related Art

In conventional practice, manifolds having pressure gauges have been used in the work of refrigerant recovery and loading for vehicular air-conditioning equipment.

Such a manifold typically comprises a manifold body and valves for opening and closing passages inside the manifold body.

Passages inside the manifold body include a high-pressure-side passage, a low-pressure-side passage, a recovery-side passage, a vacuum-suction-side passage, a purging passage, and a common passage via which these passages communicate. A high-pressure-side valve at least is provided to the high-pressure-side passage, and a low-pressure-side valve is provided at least to the low-pressure-side passage.

In times such as the height of summer in particular, post-diagnostic cool checks are performed on a cooler unit.

In a manifold having the above configuration, high-pressure liquid refrigerant and compressor oil tend to remain in the spaces up to the connecting parts (high-pressure-side quick joint and the like) leading from the high-pressure-side valve and the high-pressure-side pressure gauge to the high-pressure-side hose after a post-diagnostic cool check is used on the cooler unit.

The residual liquid refrigerant and compressor oil make it impossible to maintain the appropriate regulated amount of air-conditioning refrigerant when a fixed amount is loaded, and as a result, the air conditioning will not be consistently effective.

A known example of a configuration that can resolve the problem of residual liquid refrigerant and compressor oil is one in which, e.g., a three-way joint is connected with a gauge manifold either directly or via a straight joint between a high-pressure hose and a low-pressure hose, and the connection port of the high-pressure valve and the left and right connection ports of the three-way joint attached to the gauge manifold are fastened by flare nuts via copper valves, hoses, or the like (for example, see Patent Document 1).

PRIOR ARTS LIST

Patent Document 1: Japanese Laid-open Patent Publication No. 6-88660

SUMMARY OF THE INVENTION

An acknowledged effect of the configuration described above is that high-pressure gas and compressor lubricating oil filled into the high-pressure hose and high-pressure pressure gauge of the gauge manifold can be recovered in a low-pressure-side air-conditioning cycle.

However, in this configuration, a high-pressure-side valve and a low-pressure-side valve are secured, and it is always possible to open and close the high-pressure-side valve and the low-pressure-side valve.

Therefore, there is a possibility that the high-pressure side and low-pressure side could be mistakenly connected during times such as the air conditioning operation.

For example, when the high-pressure-side valve is mistakenly opened while refrigerant gas from a service canister (a refrigerant supply container) from the low-pressure side is being replenished, high pressure is exerted on the service canister which could then rupture.

Therefore, the configuration of the invention according to Patent Document 1 has presented serious safety-related problems.

When R1234yf or another recently popular refrigerant is used, it is standard for the quick joints to have structures such that the valves do not open without the joints being inserted into the ports, from a safety standpoint. With these structures, however, the air in the quick joints and in the pipes continuing into the quick joints cannot be purged in advance by the quick joints alone, as has been done in conventional practice.

Therefore, it would be more desirable if the quick joints could contribute to purge air while the safety concern described above is addressed.

The present invention was devised in view of the circumstances described above, a problem to be solved by the invention being to provide a superior refrigerant recovery/loading manifold in which it is possible to maintain the appropriate regulated amount when loading a fixed amount of air-conditioning refrigerant according to residual liquid refrigerant and/or compressor oil in a high-pressure side, and to avoid risks posed by erroneous valve operation to ensure safety.

In addition to the above-described problem to be solved, another problem to be solved by the invention is to provide a refrigerant recovery/loading manifold of which the workload can be further reduced.

Yet another problem to be solved by the invention is to provide a refrigerant recovery/loading manifold in which it is possible to maintain the appropriate regulated amount when loading a fixed amount of air-conditioning refrigerant according to residual liquid refrigerant and/or compressor oil in a high-pressure side, to avoid risks posed by erroneous valve operation to ensure safety, and to purge air as well, even when quick joints adapted for R1234yf or another refrigerant are used.

A means for solving the problem described above is a refrigerant recovery/loading manifold for air-conditioning equipment, comprising a manifold body and valves for opening and closing a passage inside the manifold body;

the passages including a high-pressure-side passage, a low-pressure-side passage, a recovery-side passage, a vacuum-suction-side passage, a purging passage, and a common passage via which these passages communicate;

at least a high-pressure-side valve being provided to the high-pressure-side passage, and at least a low-pressure-side valve being provided to the low-pressure-side passage; wherein a high-pressure connection means is provided to the low-pressure-side passage, the high-pressure connection means having a valve mechanism and being able to connect with a high-pressure-side quick joint.

The wording "the passages including a high-pressure-side passage, a low-pressure-side passage, a recovery-side passage, a vacuum-suction-side passage, a purging passage, and a common passage via which these passages communicate" herein includes the concept of passages of a plurality of functions being provided in a single passage, such as, e.g., the recovery-side passage and the vacuum-suction-side passage both being used in a single passage.

Another means in the present invention for solving the problem described above is a refrigerant recovery/loading manifold for air-conditioning equipment, comprising a manifold body and valves for opening and closing a passage inside the manifold body;

the passages including a high-pressure-side passage, a low-pressure-side passage, a recovery-side passage, a vacuum-suction-side passage, a purging passage, and a common passage via which these passages communicate;

at least a high-pressure-side valve being provided to the high-pressure-side passage, and at least a low-pressure-side valve being provided to the low-pressure-side passage; wherein a high-pressure connection means is provided to the low-pressure-side passage, the high-pressure connection means having a valve mechanism and being able to connect with a high-pressure-side quick joint, and the valve mechanism of the high-pressure connection means being a valve-core-equipped valve.

Another means in the present invention for solving the problem described above is a refrigerant recovery/loading manifold for air-conditioning equipment premised on either invention described above, wherein the manifold body or the pipe section connected thereto is provided with a low-pressure connection means capable of connecting with a quick joint and having a purging passage.

According to the present invention, a refrigerant recovery/loading manifold comprises a manifold body and valves for opening and closing a passage inside the manifold body, the passages including a high-pressure-side passage, a low-pressure-side passage, a recovery-side passage, a vacuum-suction-side passage, a purging passage, and a common passage via which these passages communicate, at least a high-pressure-side valve being provided to the high-pressure-side passage, and at least a low-pressure-side valve being provided to the low-pressure-side passage; wherein a high-pressure connection means is provided to the low-pressure-side passage, the high-pressure connection means has a valve mechanism, and the high-pressure connection means can be connected with a high-pressure-side quick joint connected via a high-pressure hose to the high-pressure-side passage of the refrigerant recovery/loading manifold; therefore, the manifold can be operated while the high-pressure-side valve remains closed, the high-pressure-side quick joint cannot be connected to the high-pressure connection means of the low-pressure-side passage as long as the quick joint is not separated from the cooler compressor, and remnants of liquid refrigerant and compressor oil can be resolved safely without opening the high-pressure-side valve.

In the configuration of the invention described above, the high-pressure-side valve and the low-pressure-side valve need not be operated and there is no need to provide pipes involving complicated design, merely due to the high-pressure-side quick joint being connected to the high-pressure connection means of the low-pressure-side passage; therefore, the workload can be further reduced, and the easy operation is useful to maintaining the appropriate regulated amount of air-conditioning refrigerant.

In the invention according to the second aspect, which is premised on the configuration of the invention described above, because a valve-core-equipped valve is provided as a valve mechanism of the high-pressure connection means, the high-pressure connection means can be opened in a simple manner and operated with greater ease in a work environment merely by operating the high-pressure-side quick joint, in addition to achieving the operational effects of the invention described above.

In the invention according to the third aspect, which is premised on the configuration of either invention described above, because either the manifold body or the pipe section connected thereto is provided with a low-pressure connection means capable of connecting with a quick joint and having a purging passage, a purging passage is ensured, enabling air purging even with the quick joint adapted to R1234yf or another refrigerant which is released only after the valve of the quick joint is connected, and the same operational effects as those of the invention according to the first or second aspect can be achieved.

DESCRIPTION OF THE PREFERRED EMBODIMENTS

The refrigerant recovery/loading manifold according to an embodiment of the present invention is described below. The present invention is not limited to this embodiment.

Embodiments

The refrigerant recovery/loading manifold 1 according to the present embodiment is connected between a refrigerant recovery/loading device and a vehicular air-conditioning system when a series of operations including refrigerant recovery, vacuum suction, and refrigerant loading for the vehicular air-conditioning system is performed using the refrigerant recovery/loading device, and the manifold is used by switching valves and some pipes according to the steps of the refrigerant recovery/loading device. Below is a description of the basic configuration of the refrigerant recovery/loading manifold 1 according to the embodiment of the present invention.

Figure 1:
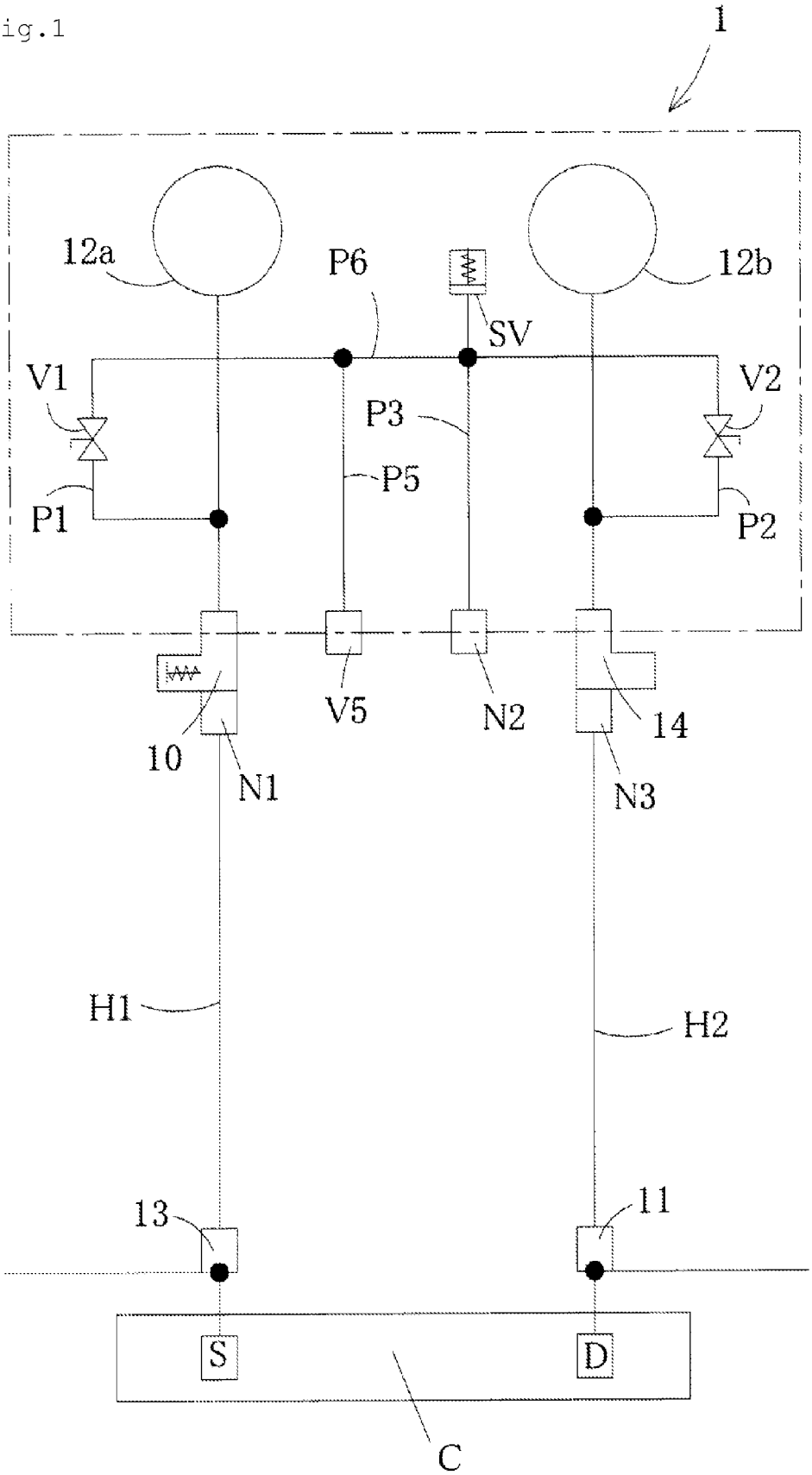
FIG. 1 is an explanatory drawing showing a piping configuration set up for refrigerant loading and recovery in the refrigerant recovery/loading manifold according to an embodiment of the present invention.

A manifold body 1*a* according to the embodiment of the present invention is provided with a low-pressure-side passage P1, a high-pressure-side passage P2, a vacuum suction passage P3, a purging passage P5, a linking passage P6 as a common passage according to the present invention whereby the aforementioned passages are linked, as shown in FIG. 1.

Figure 2:
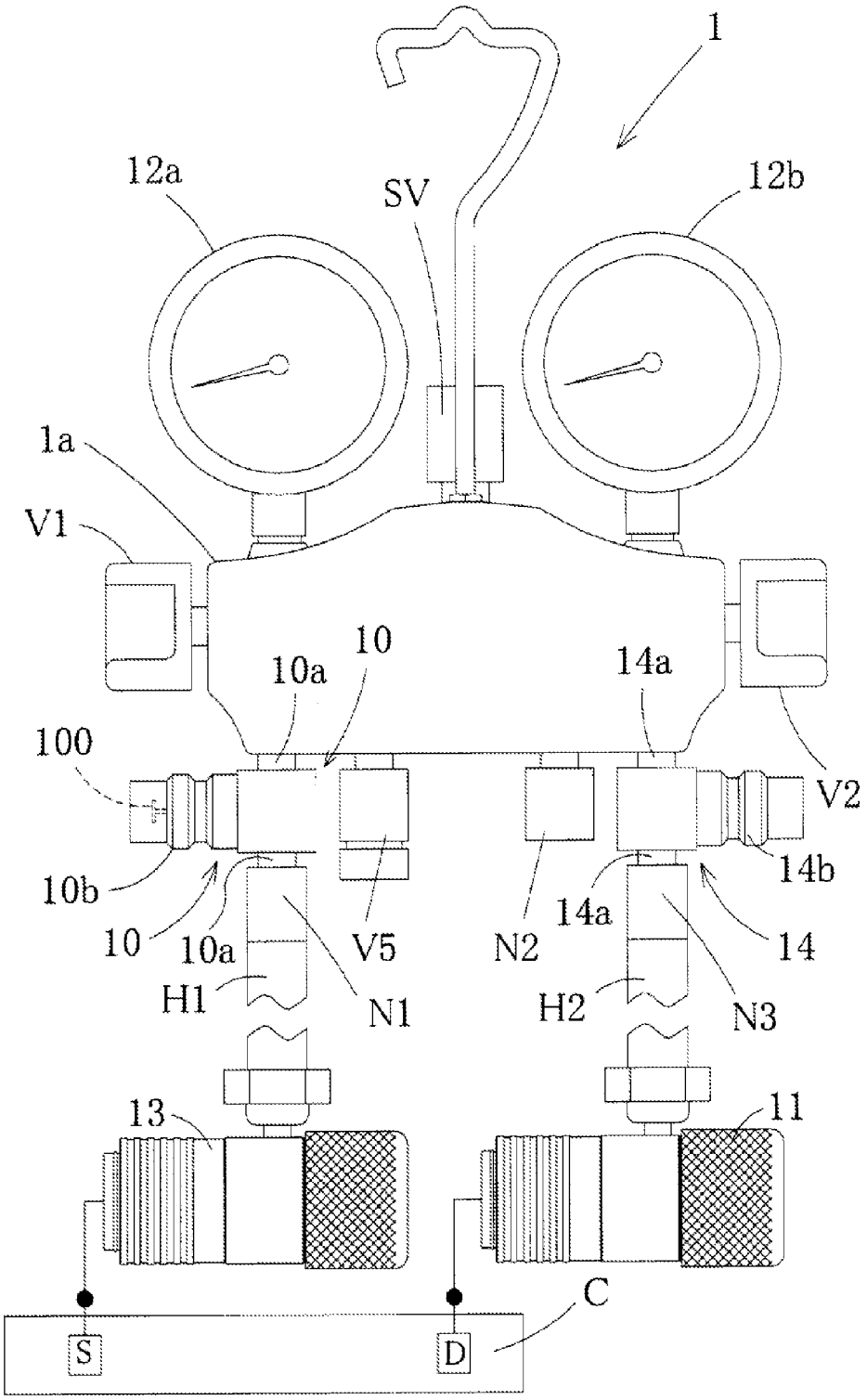
FIG. 2 is a front view of the refrigerant recovery/loading manifold according to the embodiment of the present invention.

The low-pressure-side passage P1 of the manifold body 1*a* according to the present embodiment is provided with a low-pressure-side valve V1, a high-pressure coupling 10, which is a high-pressure connection means, and a coupling N1, as shown in FIGS. 1 and 2.

The high-pressure-side passage P2 of the manifold body 1*a* according to the present embodiment is provided with a high-pressure-side valve V2, a low-pressure coupling 14, which is a low-pressure connection means, and a coupling N3.

The vacuum suction passage P3 is provided with a coupling N2.

The purging passage P5 is provided with a purge valve V5 having an explosion-proof mechanism. The linking passage P6 is provided with a safety valve SV.

A low-pressure pressure gauge 12*a* is provided between a low-pressure-side quick joint 13 and the low-pressure-side valve V1 in the low-pressure-side passage P1, and a high-pressure pressure gauge 12*b* is provided between a high-pressure-side quick joint 11 and the high-pressure-side valve V2 in the high-pressure-side passage P2.

Figure 3:
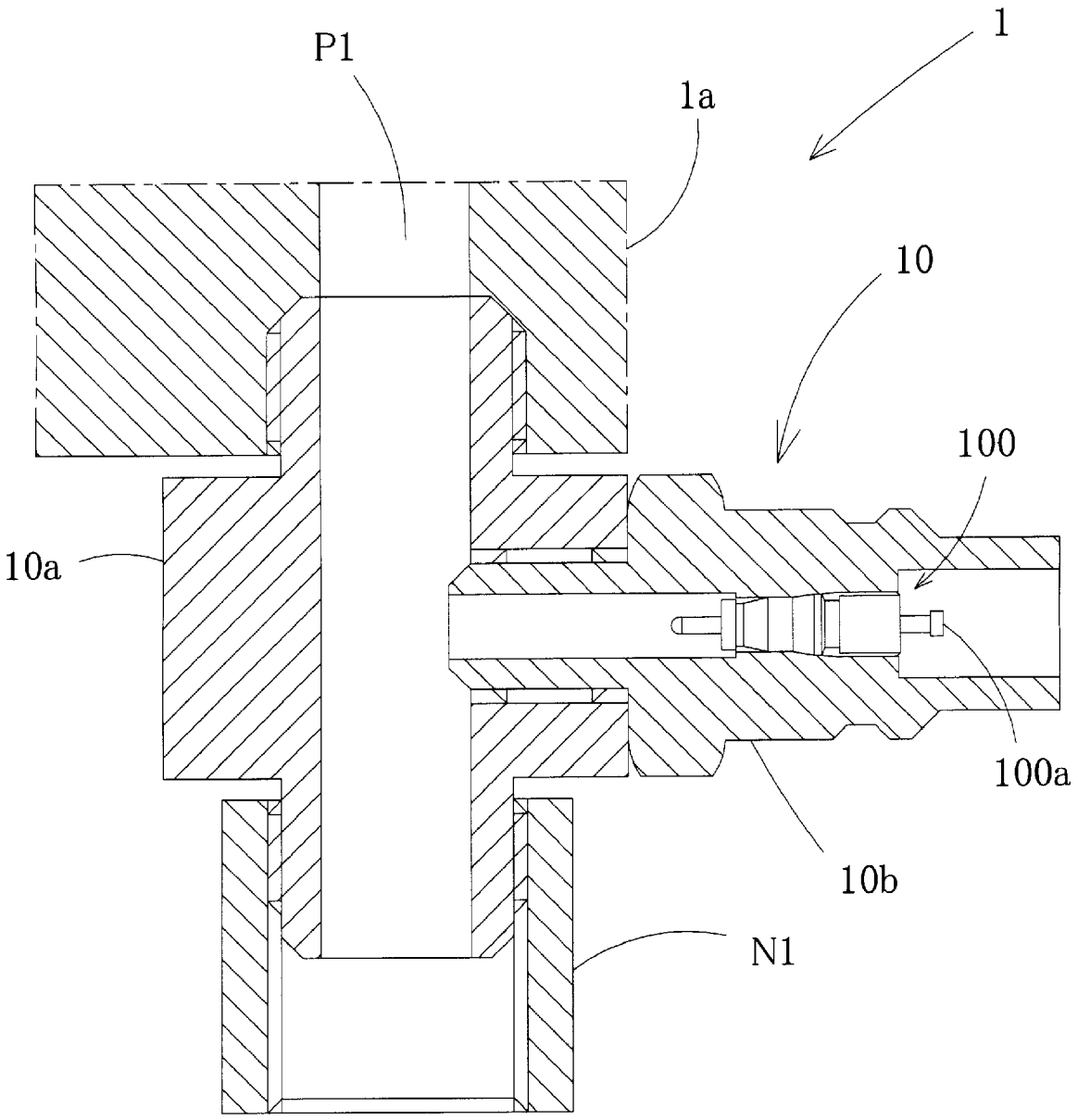
FIG. 3 is a partial enlarged cross-sectional view, seen from the left side, showing a high-pressure coupling and peripheral edge thereof constituting the refrigerant recovery/loading manifold according to the embodiment of the present invention.

The high-pressure coupling 10 is provided with a connecting part 10*a* for connecting to the refrigerant recovery/loading manifold 1, and a high-pressure-side connecting part 10*b* as a part to connect with the high-pressure-side quick joint 11. The high-pressure-side quick joint 11 can be connected to the low-pressure-side passage P1. A valve-core-equipped valve 100 is provided inside the high-pressure-side connecting part 10*b* in the high-pressure coupling 10, as shown in FIG. 3.

A valve core 100*a* in the valve-core-equipped valve 100 is urged toward the exterior by an internal spring member (not shown), ensuring that the valve is closed. The valve core 100*a* retracts due to being pressed inward by a shaft body 111 of the external high-pressure-side quick joint 11 against the spring elasticity of the spring member, and while the valve core remains retracted, the valve is kept open.

Figure 7:
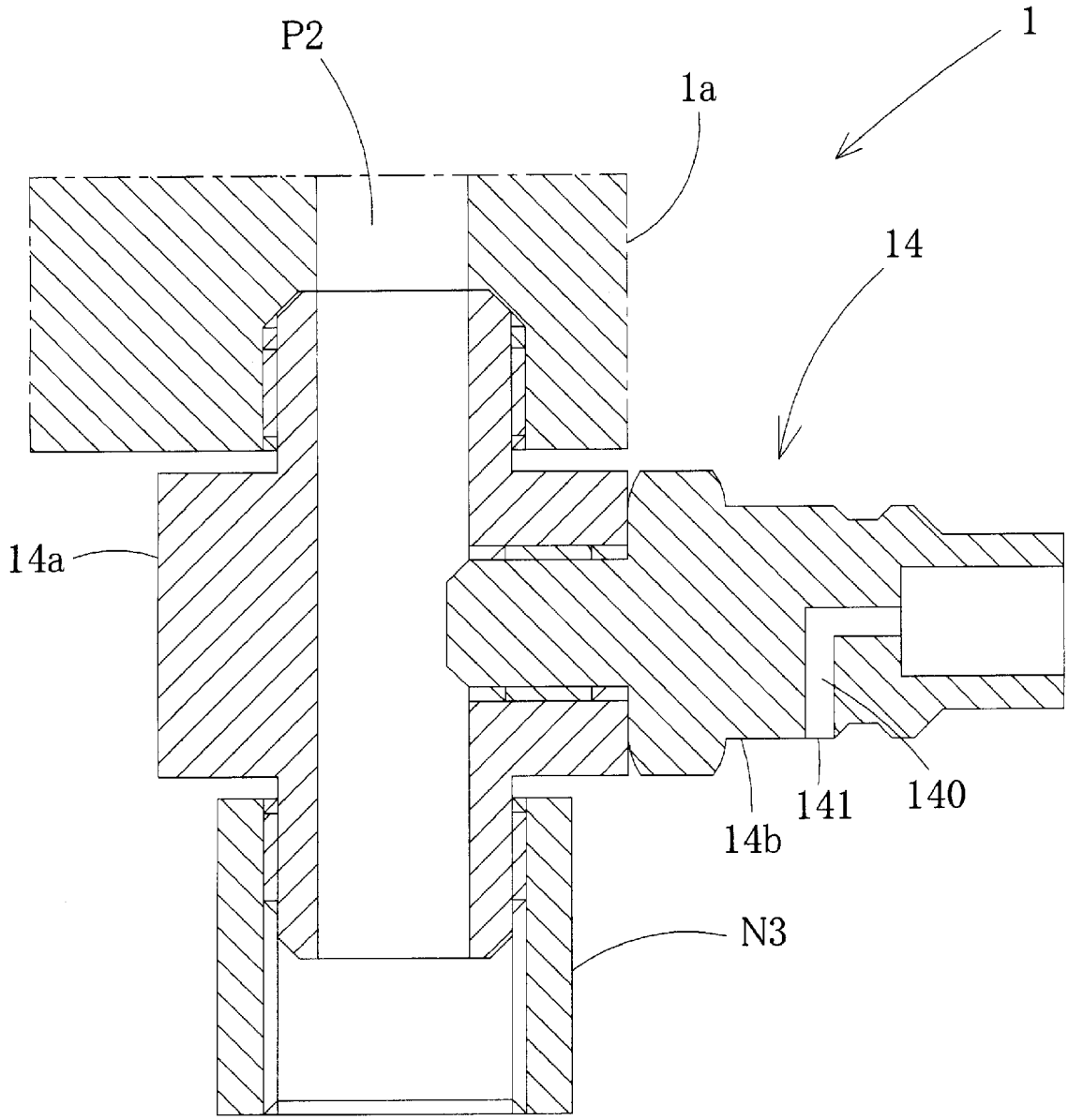
FIG. 7 is a partial enlarged cross-sectional view, seen from the left side, of a configuration in which a low-pressure coupling as a low-pressure connection means is linked to a high-pressure-side passage in the refrigerant recovery/loading manifold according to the embodiment of the present invention.

The low-pressure coupling 14, which is a low-pressure connection means provided to the high-pressure-side passage P2, is provided with a connecting part 14*a* and a low-pressure connecting part 14*b*, as shown in FIGS. 2, 7, and others.

The connecting part 14*a* and the low-pressure connecting part 14*b* are formed integrally, and there is no passage connected between the connecting part 14*a* and the low-pressure connecting part 14*b*. The connecting part 14*a* is part of the high-pressure-side passage P2, and the low-pressure connecting part 14*b*, not connected with the high-pressure-side passage P2, is independent.

The low-pressure connecting part 14*b* functions as a low-pressure connection means, and has a structure for functioning as a purging member unlike the high-pressure-side connecting part 10*b*.

Specifically, there is provided a purging passage 140 that has an outer shape allowing connecting with the low-pressure-side quick joint 13, and continues from a distal-end opening of the low-pressure connecting part 14*b* to a side surface hole 141. In other words, the low-pressure connecting part 14*b* is a dummy connecting part capable of connecting with the low-pressure-side quick joint 13 and having the purging passage 140, but not connected with the high-pressure-side passage P2.

The coupling N1 connects a low-pressure-side hose H1 and the low-pressure-side quick joint 13 continuing into this hose to the refrigerant recovery/loading manifold 1.

The coupling N3 connects a high-pressure-side hose H2 and the high-pressure-side quick joint 11 continuing into this hose, as shown in FIG. 1.

The coupling N2 connects a vacuum suction valve and a vacuum suction pump to the coupling N2 via a vacuum pump hose when vacuum suction is performed.

When gas charging (refrigerant loading) is performed without vacuum suction, a refrigerant supply container is connected to the coupling N2 via a loading hose.

The high-pressure-side quick joint 11 connects to a high-pressure-side connection port D of a cooler compressor C. The low-pressure-side quick joint 13 connects to a low-pressure-side connection port S of the cooler compressor C.

When a connection is made and the refrigerant recovery/loading manifold 1 is used for charging gas from a refrigerant gas supply container to an air conditioner, air in the quick joints and charging hoses must be removed by purging in advance.

Air in the refrigerant recovery/loading manifold 1 and in the hoses and quick joints connected thereto is exhausted.

When typical quick joints used in conventional practice are used during air purging, air can be purged by operations such as loosening attachment screws in the proximity of the quick joints or opening the valves of the quick joints.

When R1234yf or another recently popular refrigerant is used, it is standard for the quick joints to have structures such that the valves do not open without the joints being inserted into the ports, from a safety standpoint.

Because the quick joints have structures such that the valves do not open without the joints being inserted into the ports, and also because the quick joints are structured to be firmly secured with the charging hoses using a tool from the standpoint of preventing leaks, it is difficult to remove the air in the quick joints and charging hoses by purging, but the quick joints can be used in the present invention through, e.g., the following procedure.

1. The high-pressure-side valve V2 and the low-pressure-side valve V1 of the refrigerant recovery/loading manifold 1 are closed.

2. The refrigerant supply container is connected to the gas charge hose.

3. The valve of the refrigerant supply container is opened.

4. An air purge valve of the refrigerant recovery/loading manifold 1 is pressed twice in the span of approximately 0.5 seconds, and the inside of the manifold body 1*a* is purged.

5. The high-pressure-side and low-pressure-side quick joints 11, 13 are attached to the high-pressure coupling 10 and low-pressure coupling 14 respectively. The valves of the quick joints 11, 13 remain closed.

6. The valve of the high-pressure-side quick joint 11 is opened.

7. The high-pressure-side valve V2 of the refrigerant recovery/loading manifold 1 is opened.

Figure 8:
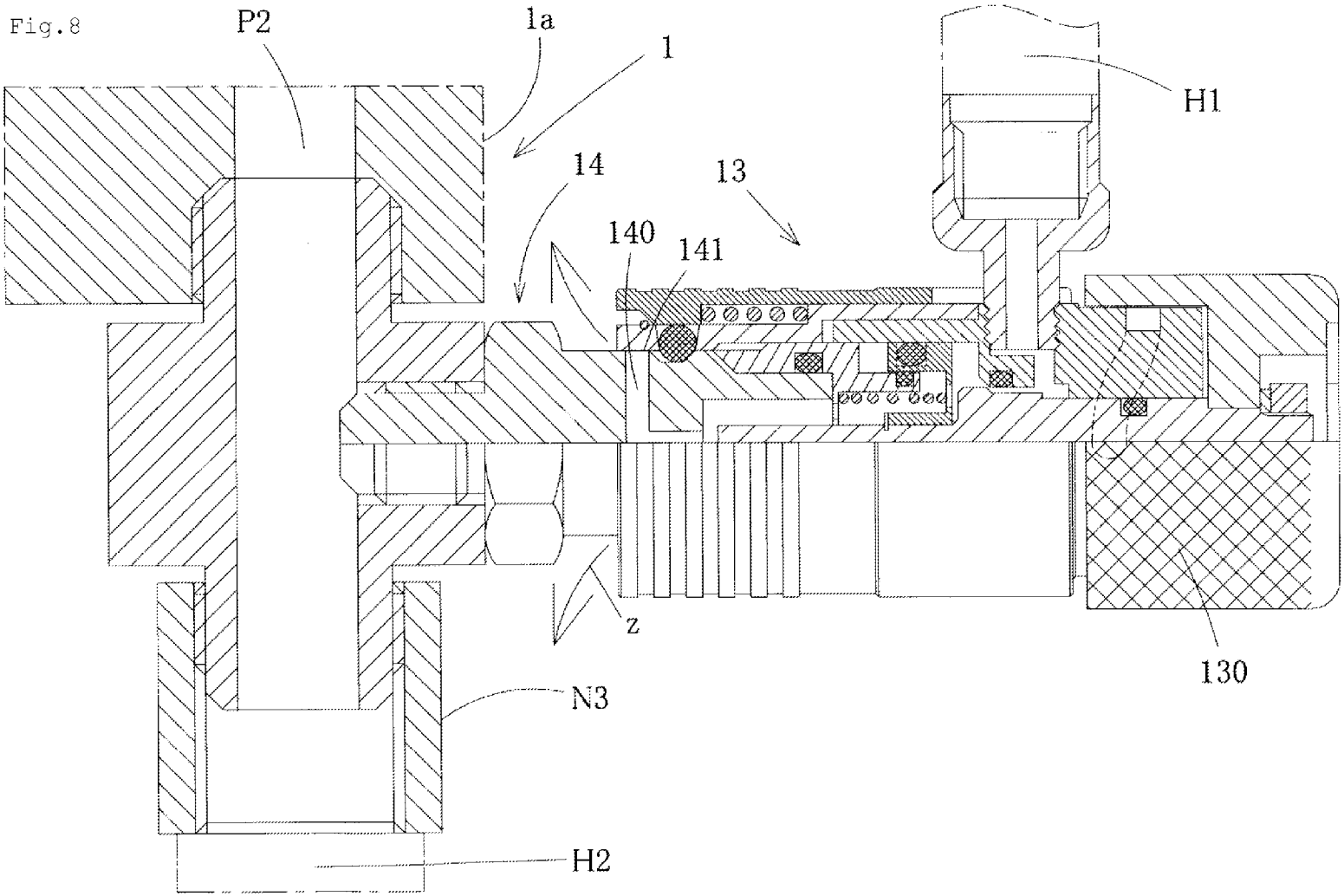
FIG. 8 is a partial enlarged cross-sectional view, seen from the left side, showing a low-pressure-side quick joint as being connected to the low-pressure coupling of the refrigerant recovery/loading manifold according to the embodiment of the present invention.

8. The valve of the low-pressure-side quick joint 13 is opened and air is purged for two seconds, after which the valve is again closed (see FIG. 8).

The valve is opened by rotating an operating part 130 of the low-pressure-side quick joint 13 by 90° to the right relative to the axial direction. The valve is closed by rotating the operating part 130 by 90° to the left relative to the axial direction. Air is expelled from the side surface hole 141 via the purging passage 140 in the low-pressure connecting part 14*b* of the refrigerant recovery/loading manifold 1, and the air purging of the interior of the high-pressure-side hose H2 is complete.

9. The valve of the high-pressure-side quick joint 11 and the high-pressure-side valve V2 of the refrigerant recovery/loading manifold 1 are closed.

10. The low-pressure-side valve V1 of the refrigerant recovery/loading manifold 1 is opened.

11. The valve of the low-pressure-side quick joint 13 is opened and air is purged for two seconds, after which the valve is again closed. Air is expelled from the opening in the side surface of the low-pressure connecting part 14*b* of the refrigerant recovery/loading manifold 1, and the air purging of the interior of the low-pressure-side hose H1 is complete.

12. While the valves of the high-pressure-side quick joint 11 and the low-pressure-side quick joint 13 remain closed, these quick joints are removed from the refrigerant recovery/loading manifold 1.

13. The high-pressure-side quick joint 11 and the low-pressure-side quick joint 13 are attached to the high-pressure-side connection port D and the low-pressure-side connection port S of the cooler compressor.

14. With the valve of the high-pressure-side quick joint 11 closed, only the valve of the low-pressure-side quick joint 13 is opened, the cooler compressor is operated, the valve of the refrigerant supply container is opened, and refrigerant gas is drawn into the system of the low-pressure side.

In the procedure described above, air purging can be completed and the refrigerant recovery/loading manifold 1 in the present invention can be used even with quick joints used with R1234yf or another refrigerant.

Figure 6:
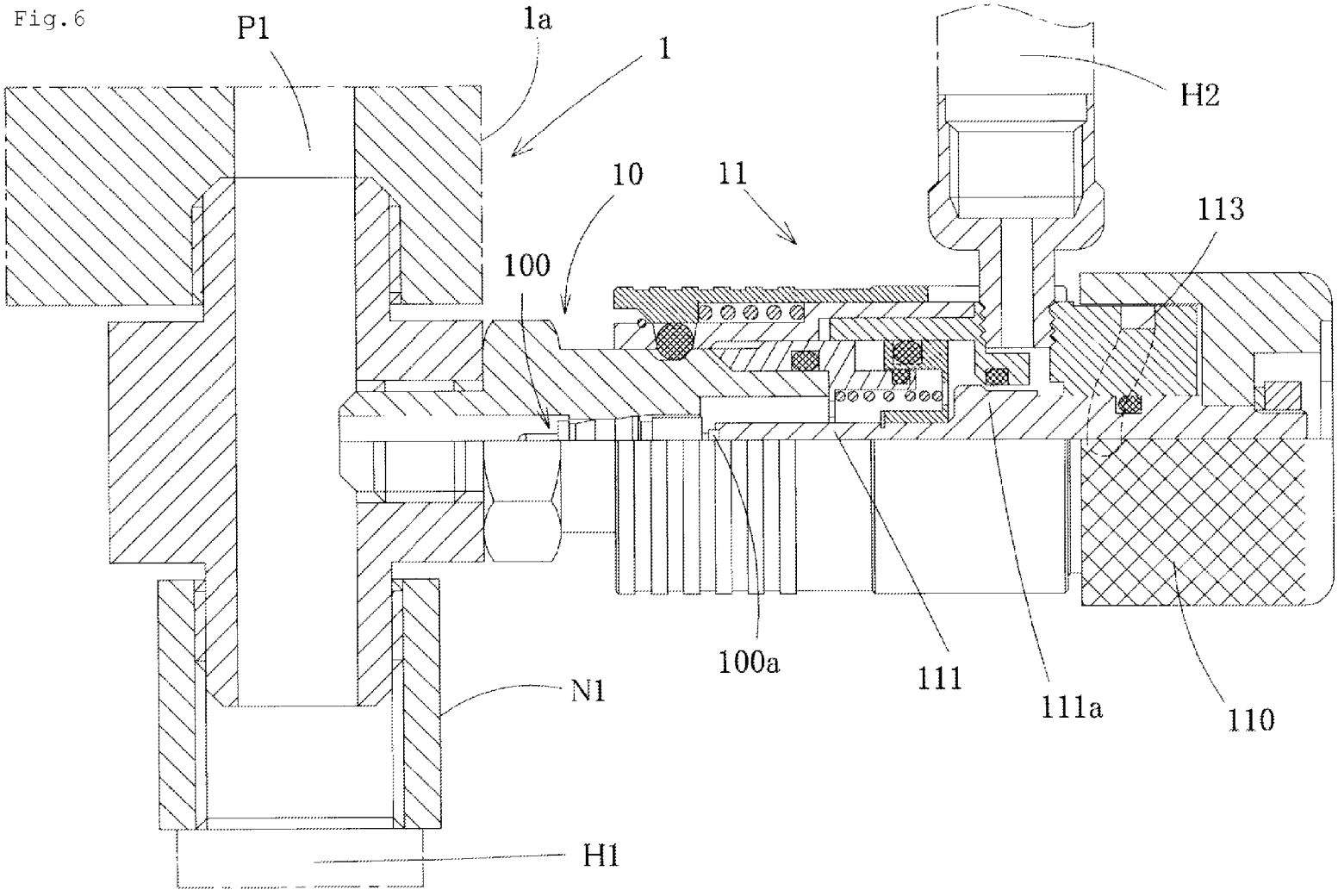
FIG. 6 is a partial enlarged cross-sectional view, seen from the left side, showing the high-pressure-side quick joint as being connected to the high-pressure coupling of the refrigerant recovery/loading manifold according to the embodiment of the present invention.

The shaft body 111 is provided in the center of the high-pressure-side quick joint 11, as shown in FIGS. 3 and 6. The shaft body 111 is provided with a valve 111*a* partially enlarged in diameter, and is configured to switch between opening and closing the valve 111*a* depending on whether or not this location forms a gap with the periphery.

The rear end of the shaft body 111 is linked to a shaft body operating part 110, and rotating the shaft body operating part 110 to the right relative to the main body of the high-pressure-side quick joint 11 causes the shaft body 111 to move forward and the valve 111*a* in the high-pressure-side quick joint 11 to open.

Rotating the shaft body operating part 110 in reverse (to the left) causes the shaft body 111 to return rearward and the valve 111*a* in the high-pressure-side quick joint 11 to close. The high-pressure-side quick joint 11 is also only allowed to rotate within a range of 90° about the axial center by a guide groove 113 formed in a spiral shape in the main body of the high-pressure-side quick joint 11 and a guide protuberance (not shown) formed in the inner surface of the shaft body operating part 110. The joint is therefore simple and easily workable.

When the high-pressure-side quick joint 11 configured as described above is inserted into the high-pressure-side connecting part 10*b* of the high-pressure coupling 10, an engaging part of the high-pressure-side quick joint 11 interlocks with a concave part in the external periphery of the high-pressure-side connecting part 10*b*, positioning the joint.

Next, rotating the shaft body operating part 110 of the high-pressure-side quick joint 11 to the right causes the shaft body 111 to move forward, opening the valve 111*a* inside the high-pressure-side quick joint 11, and the valve core 100*a* of the valve-core-equipped valve 100 is pressed by the distal end of the shaft body 111, opening the high-pressure coupling 10.

Figure 4:
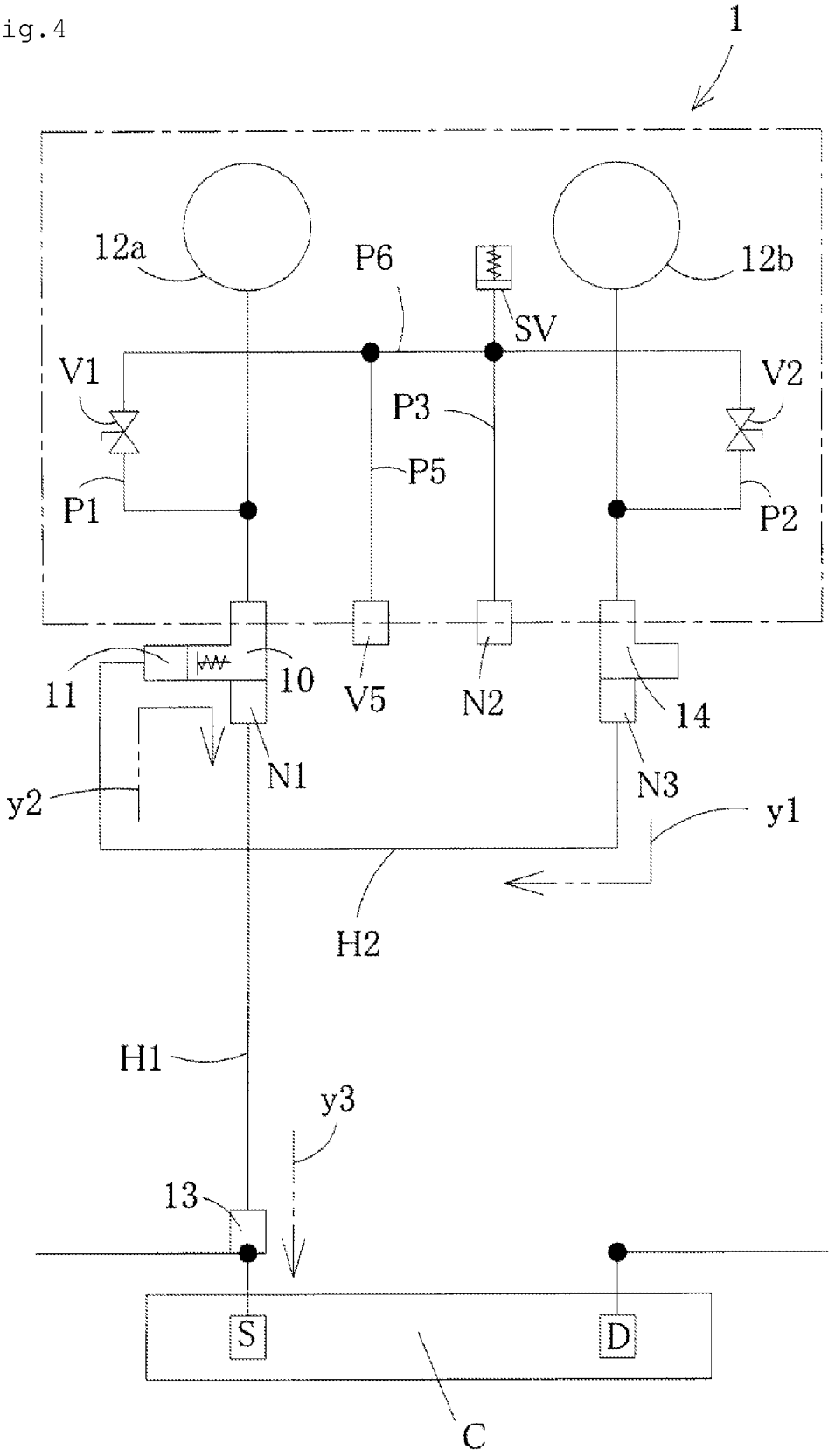
FIG. 4 is an explanatory drawing showing a piping configuration set up for liquid refrigerant remaining in the high-pressure side to be recovered to the low-pressure side in the refrigerant recovery/loading manifold according to the embodiment of the present invention.
Figure 5:
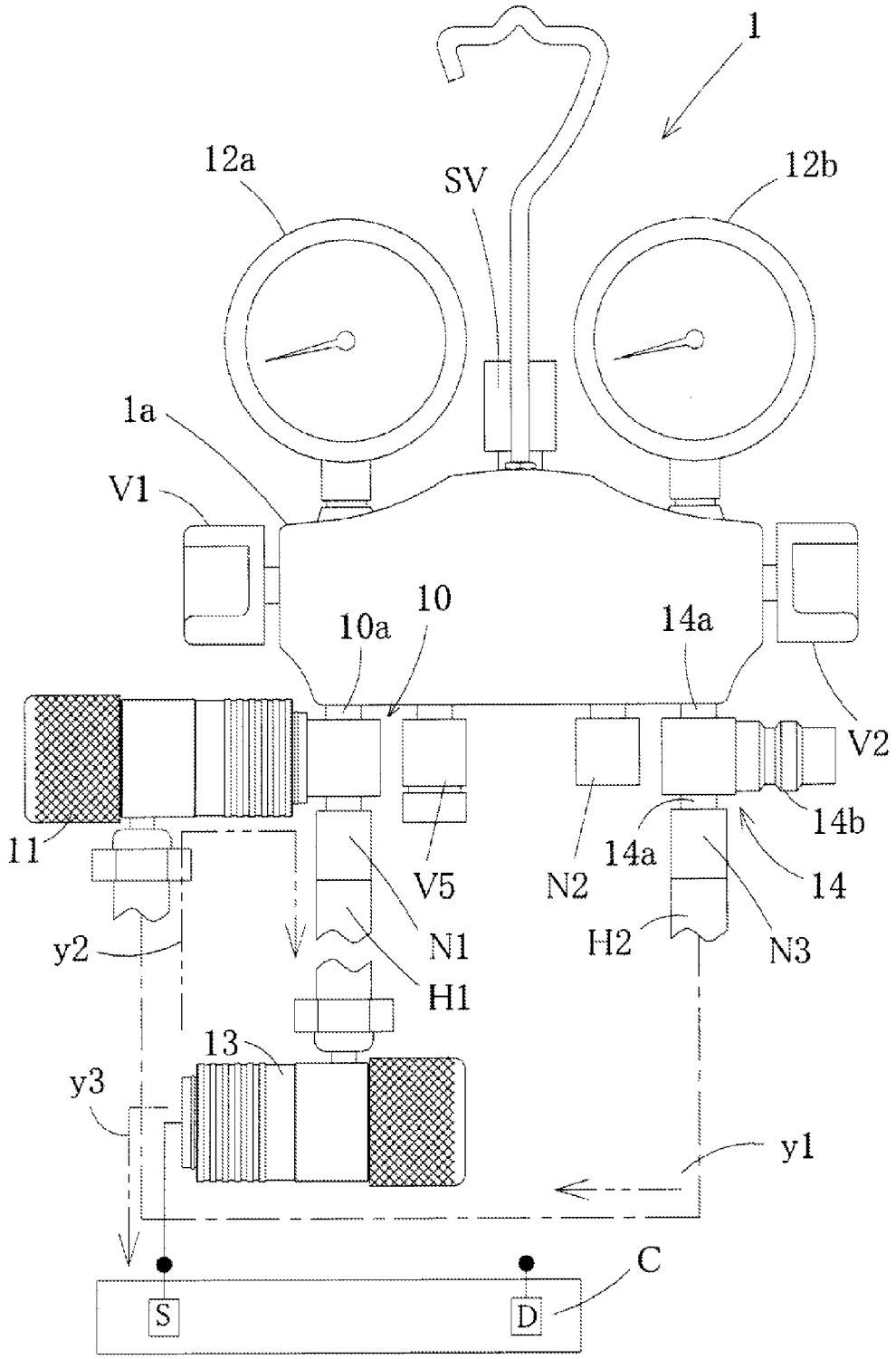
FIG. 5 is a front view of the refrigerant recovery/loading manifold according to the embodiment of the present invention, showing a high-pressure-side quick joint as being connected to the high-pressure coupling in a low-pressure-side passage of the refrigerant recovery/loading manifold.

In this state, the cooler compressor C can be operated to return the residual liquid refrigerant and/or compressor oil from the high-pressure-side hose H2 side, through the high-pressure-side quick joint 11, the high-pressure coupling 10, and the low-pressure-side quick joint 13, to the low-pressure-side connection port S of the cooler compressor C, in order of the routes y1, y2, and y3 in FIGS. 4 and 5.

During the disconnecting operation, when the shaft body operating part 110 is rotated in reverse to disconnect the shaft body 111 from the valve core 100*a* of the valve-core-equipped valve 100, the valve core 100*a* of the valve-core-equipped valve 100 is returned to the original closed position by the spring elasticity of the internal spring member, and the flow channel is closed. The valve 111*a* in the high-pressure-side quick joint 11 is also closed by the retracting of the shaft body 111.

As described above, when the shaft body operating part 110 of the high-pressure-side quick joint 11 is connected and disconnected, because rotation is allowed only within a range of 90° about the axial center by the guide protuberance and the spiral guide groove 113 formed in the main body of the high-pressure-side quick joint 11, the valve can be opened and closed at this rotational angle.

The work of air purging in the refrigerant recovery/loading manifold 1 can be performed by similarly pressing a push-button of the purge valve V5 when the hoses are reconnected to prescribed couplings and valves in each step of refrigerant recovery, vacuum suction, and refrigerant loading which are successively performed.

According to the present invention as described above, the invention is not limited to the present embodiment, and a high-pressure coupling 10 corresponding to the high-pressure-side quick joint 11 may be provided in the low-pressure-side passage P1 of the refrigerant recovery/loading manifold 1. Therefore, the corresponding high-pressure-side quick joint 11 is not limited to that shown in the above embodiment, and is not particularly limited as long as it is able to correspond to the high-pressure coupling 10.

The low-pressure connection means in the present invention is means for performing air purging, and the attachment position thereof is therefore not particularly limited to the position disclosed in the embodiment and can be decided as appropriate within the range of design matters, according to convenience.

According to the present invention, in the configuration described above, normally refrigerant recovery/loading manifold 1 is configured with only the high-pressure coupling 10 provided to the low-pressure-side passage P1, and the high-pressure-side quick joint 11 is connected with the high-pressure coupling 10 provided to the low-pressure-side passage P1, whereby liquid refrigerant and/or compressor oil remaining in the high-pressure side can be returned to the low-pressure-side connection port S through the product by the air-conditioning operation. Therefore, the invention is highly exceptional in that the appropriate regulated amount of air-conditioning refrigerant can be maintained when loading a fixed amount and risks from erroneous valve operation can be avoided to ensure safety, which is useful to maintaining the appropriate regulated amount of air-conditioning refrigerant.

KEY

1: refrigerant recovery/loading manifold
1*a*: manifold body
10: high-pressure coupling
10*a*: connecting part
10*b*: high-pressure-side connecting part
100: valve-core-equipped valve
100*a*: valve core
11: high-pressure-side quick joint
110: shaft body operating part
111: shaft body
111*a*: valve
113: guide groove
12*a*: low-pressure pressure gauge
12*b*: high-pressure pressure gauge
13: low-pressure-side quick joint
130: operating part
14: low-pressure coupling
14*a*: connecting part
14*b*: low-pressure connecting part
140: purging passage
141: side surface hole
C: cooler compressor
D: high-pressure-side connection port
H1: low-pressure-side hose
H2: high-pressure-side hose
P1: low-pressure-side passage
P2: high-pressure-side passage
P3: vacuum suction passage
P5: purging passage
P6: linking passage (common passage)
SV: safety valve
S: low-pressure-side connection port
V1: low-pressure-side valve
V2: high-pressure-side valve
N1: coupling (for connecting to low-pressure-side hose)
N2: coupling (for connecting to gas charger or vacuum pump)
N3: coupling (for connecting to high-pressure-side hose)
V5: purge valve
y1: route
y2: route
y3: route
z: arrow showing direction of air purge

What is claimed is:

1. A refrigerant recovery/loading manifold for air-conditioning equipment, comprising a manifold body and valves for opening and closing a passage inside the manifold body, the passages including a high-pressure-side passage, a low-pressure-side passage, a recovery-side passage, a vacuum-suction-side passage, a purging passage, and a common passage via which these passages communicate, at least a high-pressure-side valve being provided to the high-pressure-side passage, and at least a low-pressure-side valve being provided to the low-pressure-side passage; wherein a high-pressure connection means is provided to the low-pressure-side passage, the high-pressure connection means having a valve mechanism and being able to connect with a high-pressure-side quick joint.

2. A refrigerant recovery/loading manifold for air-conditioning equipment, comprising a manifold body and valves for opening and closing a passage inside the manifold body, the passages including a high-pressure-side passage, a low-pressure-side passage, a recovery-side passage, a vacuum-suction-side passage, a purging passage, and a common passage via which these passages communicate, at least a high-pressure-side valve being provided to the high-pressure-side passage, and at least a low-pressure-side valve being provided to the low-pressure-side passage; wherein a high-pressure connection means is provided to the low-pressure-side passage, the high-pressure connection means having a valve mechanism and being able to connect with a high-pressure-side quick joint; and the valve mechanism of the high-pressure connection means is a valve-core-equipped valve.

3. The refrigerant recovery/loading manifold according to claim 1, wherein the manifold body or a pipe section connected thereto is provided with a low-pressure connection means capable of connecting with a quick joint and having a purging passage.

4. The refrigerant recovery/loading manifold according to claim 2, wherein the manifold body or a pipe section connected thereto is provided with a low-pressure connection means capable of connecting with a quick joint and having a purging passage.

* * * * *